US005431613A

United States Patent [19]

Singleton et al.

[11] Patent Number: 5,431,613

[45] **Date of Patent: * Jul. 11, 1995**

[54] EXERCISE TREADMILL WITH GROOVED ROLLER

[75] Inventors: James M. Singleton, Allen; James A. Mann, Richardson, both of Tex.

[73] Assignee: JAS Manufacturing Co., Inc., Carrollton, Tex.

[ * ] Notice: The portion of the term of this patent subsequent to Jun. 14, 2011 has been disclaimed.

[21] Appl. No.: 258,565

[22] Filed: Jun. 10, 1994

Related U.S. Application Data

[63] Continuation of Ser. No. 89,221, Jul. 8, 1993, Pat. No. 5,320,589.

[51] Int. Cl.[6] ..... A63B 23/06

[52] U.S. Cl. ..... 482/54

[58] Field of Search ..... 482/54, 51, 148; 198/835

[56] References Cited

U.S. PATENT DOCUMENTS

| | | | |
|---|---|---|---|
| 152,628 | 6/1874 | Greaves . | |
| 3,082,858 | 3/1963 | King | 198/108 |
| 3,554,541 | 1/1971 | Seaman | 482/54 |
| 3,980,174 | 9/1976 | Conrad | 198/835 |
| 4,008,801 | 2/1977 | Reilly et al. | 198/841 |
| 5,320,589 | 6/1994 | Singleton et al. | 482/54 |

*Primary Examiner*—Stephen R. Crow

*Attorney, Agent, or Firm*—Gunn, Lee & Miller

[57] ABSTRACT

A treadmill which includes a generally rectangular frame defining a walking plane, said frame having laterally disposed parallel trending side rails (18); a drive roller, said drive roller having walls defining a hollow cylinder; a free roller (10), said free roller (10) having walls defining a hollow cylinder, the walls of said drive and said free rollers (10) each having an annular groove (38) in the outer walls (36) thereof, the groove (38) located closer to an end of said rollers (10) than the longitudinal center line of said frame; shaft (12) for mounting said rollers (10) between said rails (18) and in generally perpendicular relation; an endless belt (20) of flexible material having an outer walking surface and an inner surface, the inner surface having an inwardly projecting alignment ridge (44) mating with said grooves (38) of said rollers (10) to allow a substantially flush fit of said rollers (10) against said belt (20) and to prevent said endless belt (20) from wandering on said rollers (10).

2 Claims, 2 Drawing Sheets

EXERCISE TREADMILL WITH GROOVED ROLLER

This application is a continuation of application Ser. No. 08/089,221, filed Jul. 8, 1993, now U.S. Pat. No. 5,320,589.

FIELD OF THE INVENTION

This invention relates generally to exercise treadmills of the type used in health clubs, hospitals, rehabilitation centers and the like to provide exercise for the user. More particularly, this invention relates to a treadmill having an endless belt of flexible material driven by a drive roller and carried on a free roller, the rollers having walls defining a hollow cylinder with an annular alignment groove in the external surface thereof, for mating with an alignment ridge on the underside of the flexible endless belt.

BACKGROUND

Exercise treadmills are well known. Typically exercise treadmills will either be powered or unpowered. Powered treadmills typically have a drive roller and a free roller separated by a deck. A flexible endless belt is provided, under tension, to allow the endless belt to ride across the deck. The user walks along the outer surface of the flexible belt between the drive roller and the free roller. The deck provides support for the walking surface of the belt. Typically, the treadmill is inclined and frequently the speed of the belt may be controlled by an electronic unit which controls an electric motor.

Exercise treadmills, especially those found in institutions and health clubs undergo a lot of use and must be sturdily built. Cheaply-constructed or poorly-designed treadmills have failed in a number of areas. A particular problem area, even with well designed and well constructed treadmills, is the wear on the belt.

As the treadmill is used, the belt tends to relax and stretch. This often occurs along the outside edges and is visible when fraying occurs in this area. A stretched, worn belt will tend to wander side-to-side across the rollers. This disrupts the user and will aggravate the belt wear problem. Typically, treadmills are provided with an inch or two of exposed rollers which extend beyond the edges of the endless belt. This will allow some room for the belt to wander, but is undesirable as it decreases the walking area provided for the user. It would be advantageous if treadmills could utilize the full width of the rollers by eliminating the wandering belt problem.

The problem of belt misalignment which causes the belt to develop a tendency to wander from one side to the other when in use—has been addressed in a number of ways. Some designs use crowned rollers which have a thicker central section which tapers out to either end. While these reduce the tendency of the belt to wander from side-to-side, they are expensive to machine. In U.S. Pat. No. 3,554,451, an endless belt is disclosed which has an alignment ridge coincident with the lateral axis of the belt which mates with an annular groove in the center of the rollers. In this system, the ridged center of the belt produces a slightly convex walking surface.

The exercise treadmill of the present invention provides for annular grooves in the drive and free rollers which grooves are located, not in the center of the rollers but to one or both sides of the center. A linear groove in the deck surface aligned with the grooves in the rollers allows a flexible belt with an alignment ridge on the underside to be used, which helps prevent the belt-wandering problem. This system provides the advantage of allowing the manufacturer to use a smaller wall tubing. That is, an annular groove to one or both sides of the longitudinal axis of the belt will be less likely than a groove in the center to cause sudden roller failure or cracking at the groove.

Applicant's present invention provides for hollow cylindrical rollers mounted by bearings to axle shafts. The axles are mounted generally perpendicular to the side rails of the treadmill. The rollers have outside walls having annular grooves and alignment ridges on the underside of the endless belt, which groove/ridge is located to one side of the rollers rather than the central area, decreasing the likelihood of failure in the roller during use of the treadmill. That is, the belts are mounted between the rollers under tension which is borne by the surface of the drive and free rollers. Applicant has found a reduced likelihood of shaft failure by mounting the shaft with an annular alignment groove off of the center. The use of a single groove (asymmetrical design) has not resulted in a significant tendency of the belt to skew to one side. To the extent that such a tendency exists, it may be "adjusted out" by adjustment screws in the free roller that allow adjusting the roller in a slightly out-of-perpendicular arrangement. Such adjustment mechanisms are old in the art, having been used to address belt and machine adjustment with prior art belts.

Applicant has found that the use of a single set of grooves (two roller grooves and a deck groove) to one side of the longitudinal axis of the treadmill, rather than one set on each side or the symmetrical groove arrangements found in the prior art, to have some advantages. First, it is more difficult with a groove set on each side of the roller to maintain the same distance between the pair of alignment ridges on the belt, which often stretches with use. Once this occurs, one ridge will try to ride out of its groove, aggravating rather than maintaining proper alignment. Second, it is more expensive to have more than one set of grooves. Nonetheless, Applicants' novel invention may be practiced with annular grooves on both sides.

The foregoing and other preferred novel features will be understood from the following description of a preferred specific embodiment, which description should be read with reference to the accompanying drawings in which FIG. 1 is a perspective front view of the roller constructed according to the present invention and FIG. 2 is a perspective top view of the treadmill with the belt removed.

DETAILED DESCRIPTION OF THE PREFERRED EMBODIMENTS

Figure 1:
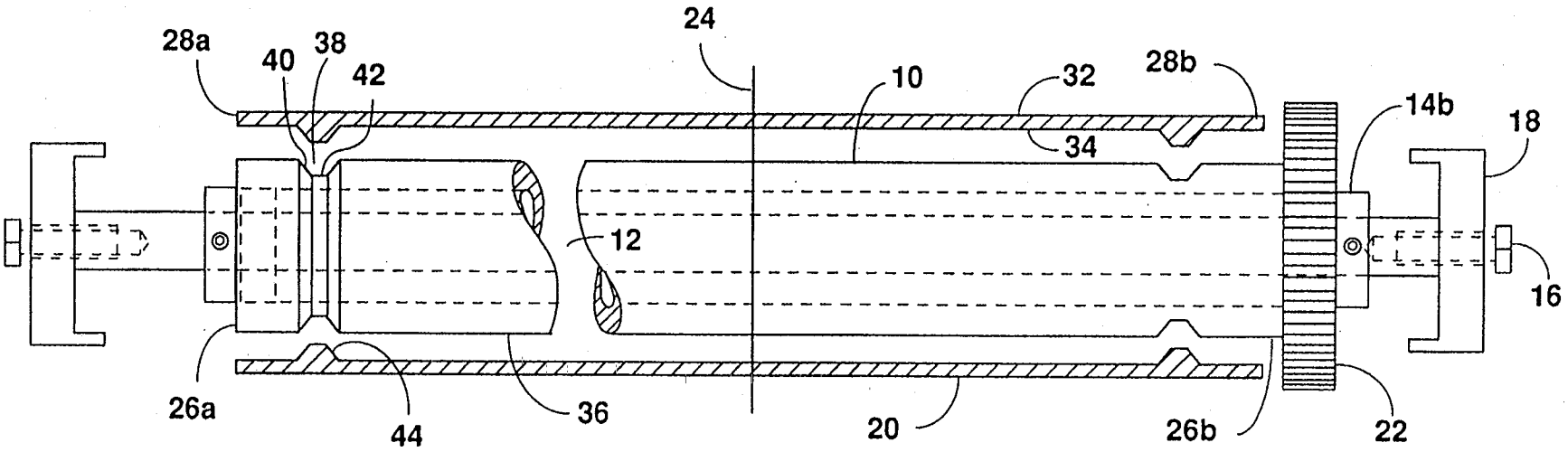
Figure 2:
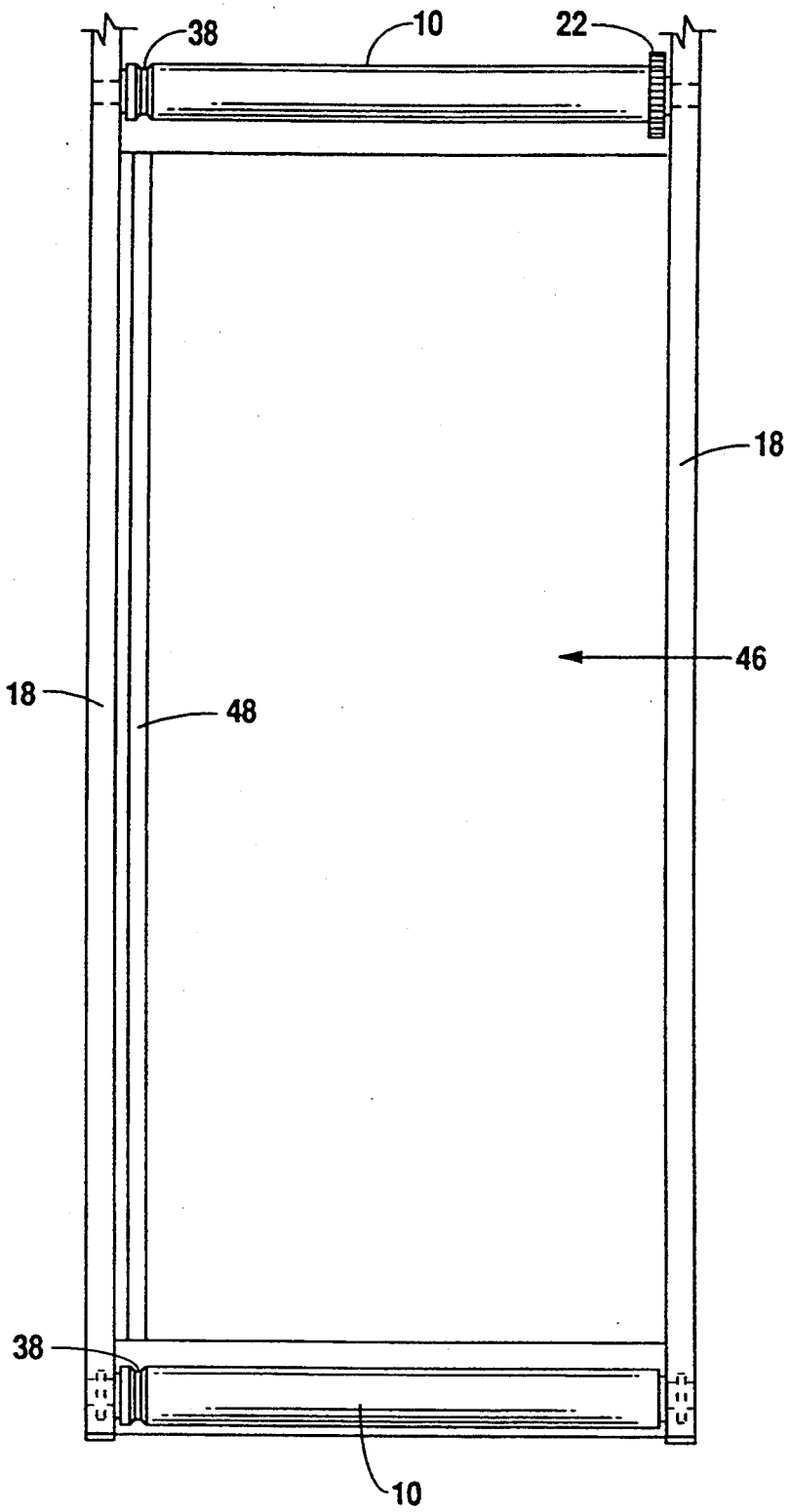

FIGS. 1 and 2 illustrate rollers (10) (one being a drive roller, the other a free roller) of the present invention. Roller (10) is seen to be a hollow cylinder typically made of cold-rolled steel with an outside diameter between 2 inches and 12 inches, and a wall thickness of between $\frac{1}{4}$-inch and 1 inch. Roller (10) is supported on mounting shaft (12) by bearings (14). Mounting shaft is typically a solid cylinder of steel between $\frac{3}{4}$-inch and 2 inches in diameter. Mounting studs (16) thread into both ends of mounting shaft (12) and pass through side rails (18) to maintain mounting shaft (12) in generally perpendicular rigid alignment with side rails (18). It is to be understood that adjustment mechanisms are known in the art by which either of the rollers (typically the free roller) may be set at angles that are not quite perpendicular with axis of the side rails. These are used to take up for differences from belt to belt when setting up a new treadmill or to correct for an uneven floor or a worn belt, to help keep the belt aligned on the rollers when the treadmill is in use.

Endless flexible belt (20) rides on rollers (10), the drive roller being driven by a motor through a drive belt engaging drive belt sprocket (22) (motor and drive belt not shown). Belt (20) has belt ends (28*a*) and (28*b*) as well as outer surface (32) and inner surface (34). Roller ends (26*a*) and (26*b*) preferably align with belt ends (28*a*) and (28*b*) or within one-fourth inch thereof. Roller (10) has outer walls (36). Applicants' unique roller (10) is provided with groove (38) preferably near either one of roller ends (26*a*) and (26*b*), but not in the center. Groove (38) preferably has matching opposed side walls (40) and a flat bottom wall (42) (this being referred to in the claims as "U-shaped"). Alignment ridge (44) is defined by a projection inward from underside (34) of belt (20) and has a cross-section that substantially matches the cross-sectional profile of groove (38). The profile is typically U-shaped. Typically, the depth of the "U" (vertical distance between outer walls (36) and bottom wall (42)) is in the range of $\frac{1}{8}$-inch to $\frac{3}{4}$-inch. Typically, groove (38) is one-inch wide at the top and one-half inch deep.

Deck (46) is provided having longitudinal groove (48) in the upper surface thereof and extending between annular grooves (38) of the rollers. The profile of groove (48) will match that of groove (38). In use, alignment ridge (44) will ride in groove (48), allowing the underside of belt (20) to lay generally flush against the top side of the deck (46).

In use, annular grooves (38) and longitudinal groove (48) will accept alignment ridge (44), the engagement of alignment ridge (44) with side walls (40) of groove (38) maintaining alignment of belt (20) on roller (10). In this manner, belt (20) is substantially prevented from wandering from side-to-side on roller (10). The engagement of ridge (44) with groove (38) will allow a substantially flush relationship between the underside of the flexible belt and the rollers.

FIG. 2 illustrates the use of a second groove/ridge set located equidistant from the center of rollers (10) as first set. While such a symmetrical system is more expensive to produce, it will reduce the belt-wandering problem.

Terms such as "left", "right", "up", "down", "bottom", "top", "front", "back", "in", "out" and the like are applicable to the embodiment shown and described in conjunction with the drawings. These terms are merely for the purposes of description and do not necessarily apply to the position or manner in which the invention may be constructed or used.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

I claim:

1. A treadmill comprising:

a generally rectangular frame defining a walking plane, said frame having laterally disposed parallel trending side rails;

a drive roller, said drive roller having walls defining a cylinder;

a free roller, said free roller having walls defining a cylinder;

said drive and said free rollers each having at least one pair of annular grooves in the outer walls thereof, the grooves located to either or both sides of a longitudinal axis of the walking plane;

shaft means for mounting said rollers between said rails in generally perpendicular relation;

an endless belt of flexible material having an outer walking surface and an inner surface, the inner surface having an inwardly projecting alignment ridge for each pair of grooves for mating with said grooves of said rollers to allow a substantially, flush fit of said rollers against said endless belt and to prevent said endless belt from wandering on said rollers; and a generally tabular deck having an upper surface, the deck extending between said rollers and parallel with the walking plane, the upper surface of said deck having walls defining a longitudinal groove, the longitudinal groove aligned with the annular grooves of said rollers, allowing the inner surface of said endless belt to lay flush against the upper surface of said deck.

2. A treadmill comprising;

a generally rectangular frame defining a walking plane, said frame having laterally disposed parallel trending side rails;

a drive roller, said drive roller having walls defining a hollow cylinder;

a free roller, said free roller having walls defining a hollow cylinder;

said drive and said free rollers having only one pair of annular grooves in the outer walls thereof, the grooves located to one side of a longitudinal axis of the walking plane;

shaft means for mounting said rollers between said rails in generally perpendicular relation;

an endless belt of flexible material having an outer walking surface and an inner surface, the inner surface having an inwardly projecting alignment ridge mating with the grooves of the pair of grooves to allow a substantially flush fit of said rollers against said belt and to prevent said endless belt from wandering on said rollers; and a deck having an upper surface, the deck extending between said rollers and parallel with the walking plane, the upper surface of said deck having walls defining a longitudinal groove extending between the pair of grooves of said rollers allowing the inner surface of said endless belt to lay flush against the Upper surface of said deck.

* * * * *